US006474201B1

(12) United States Patent
Lund

(10) Patent No.: US 6,474,201 B1
(45) Date of Patent: Nov. 5, 2002

(54) TOOL FOR ATTACHING AND REMOVING SWIVEL FITTINGS

(75) Inventor: David Lund, E. Corinth, VT (US)

(73) Assignee: Victory in Jesus Ministries, Inc., Bradford, VT (US)

( * ) Notice: Subject to any disclaimer, the term of this patent is extended or adjusted under 35 U.S.C. 154(b) by 0 days.

(21) Appl. No.: 09/723,928

(22) Filed: Nov. 28, 2000

Related U.S. Application Data

(63) Continuation-in-part of application No. 09/563,180, filed on May 2, 2000, and a continuation-in-part of application No. 09/699,247, filed on Oct. 27, 2000.

(51) Int. Cl.[7] ..... B25B 13/06

(52) U.S. Cl. ..... 81/124.2; 81/124.3; 81/180.1

(58) Field of Search ..... 81/124.2–124.7, 81/121.1, 177.1, 177.5, 177.85, 180.1, 185, 185.1, DIG. 11, 176.1, 176.15, 176.2; 279/93, 94, 89; 285/400, 401, 362, 376; 403/348, 359, 361, 364

(56) References Cited

U.S. PATENT DOCUMENTS 2,092,060 A * 9/1937 Gairing ..... 279/93
4,749,251 A * 6/1988 Moulin ..... 81/124.2 X
5,287,776 A * 2/1994 Williams et al. ..... 81/124.2
5,996,447 A * 12/1999 Bayouth ..... 81/124.2 X

* cited by examiner

*Primary Examiner*—D. S. Meislin
(74) *Attorney, Agent, or Firm*—B. Craig Killough

(57) ABSTRACT

A tool for attaching and removing threaded fittings of the type typically used to attach hoses, such as hydraulic hoses, characterized by an extended longitudinal body which is open along a length of the body to accept a hose which has a fitting on it. An adaptor is mounted on an end of the body. The adaptor accepts and rotates a fastener which is part of the hose fitting, such as a six point fastener. The adaptor has an open portion to accept the hose. The opposite end of the body accepts a drive tool, such as a ratchet or a pneumatic wrench.

6 Claims, 6 Drawing Sheets

TOOL FOR ATTACHING AND REMOVING SWIVEL FITTINGS

This application is a continuation -in-part of pending application Ser. No. 09/563,180, filed May 2, 2000, and pending application Ser. No. 09/699,247, filed Oct. 27, 2000 the teachings of which are incorporated herein by reference.

FIELD OF THE INVENTION

This invention relates to a tool for removing and attaching fittings which are used to attach hoses, such as fittings used on hydraulic hoses.

BACKGROUND OF THE INVENTION

Hydraulic hoses are mounted to hydraulic devices or to other hydraulic hoses by means of hydraulic fittings which connect the hoses to the hydraulic device or other hose. Fittings are commonly mounted to the end of the hose and have threaded means for attaching the hose to threads mounted on the device to which the hose is attached, or to the fitting of another hose. The threaded fitting typically has means for rotating a part of the fitting to secure the threads. The fitting may comprise a six-point fastener with accepts an open end wrench of the appropriate size and of the type commonly in use. Fittings typically have a swivel means, which allows the hose to rotate or pivot relative to the fitting and the device to which the device is attached.

Fittings as described, such as hydraulic fittings, may be attached by means of the threads to another threaded fitting which will accept threads. In the prior art, open end wrenches are commonly used to advance and secure the threads, and to remove fittings. The problems with using hand wrenches of this type is two-fold: (1) Rotation of the wrench is relatively slow when compared with other tools, such as ratchets; and (2) the position of the fitting relative to other parts of the machine to which the hose is attached is commonly such that access to the fitting is limited, meaning that the hand wrench either cannot be used, or rotation of the threads by means of the hand wrench is limited to a few degrees.

The use of a ratchet or impact wrench expedites the attachment and removal of various threaded fasteners. Devices known as sockets, which are usually of six point (hexagonal) or twelve point design, are attached to the ratchet or impact wrench, and the socket is rotated to secure the fastener or remove the fastener. Heretofore, no socket has been available for wrenches or impact wrenches which will allow the removal of a threaded fitting which is attached to a hose.

SUMMARY OF THE PRESENT INVENTION

The present invention provides a tool for attaching or removing fittings which are commonly used in conjunction with hoses, such as fittings attached to hydraulic hoses. The device has a removable adaptor with a hex shaped interior which engages the hose fitting, while the opposite end has a drive hole, which is typically rectangular, to accept the square drive of commonly used tools, such as ratchets, torque wrenches or impact wrenches. Interchangeable adaptors having hex shaped interiors of varying sizes the device to be used on multiple sizes of fittings.

An adaptor is mounted to the end of the body . The adaptor is removable. The adaptor engages the fitting, and is sized according to the fitting. The adaptor is mounted to the body by male-female engagement.

DESCRIPTION OF THE PREFERRED EMBODIMENT

Figure 2:
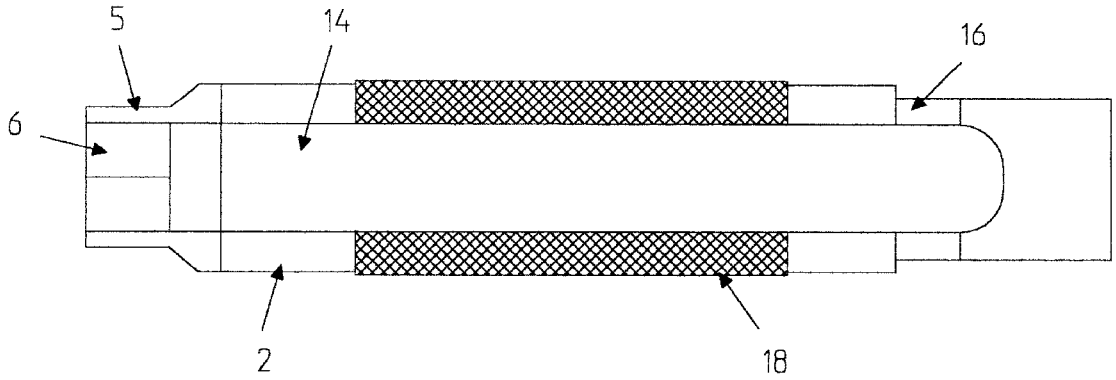
FIGS. 2 and 3 are side elevations of device.
Figure 3:
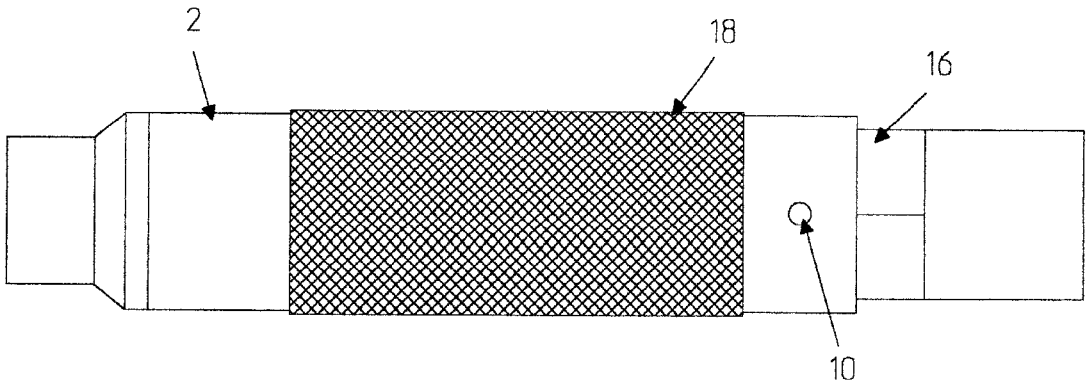

Referring now to the drawing figures, FIG. 2 shows the fitting tool having a longitudinal and hollow body 2. The body is open along a substantial portion of the length of the body to receive the hose 4 to which the fitting 8 is attached.

An adaptor 5 is fitted to an end of the body. One end of the body is formed to receive the adaptor. The adaptor has an opening 6 for receiving the fastener which is attached to the hose. The exact size of the opening will depend on the particular size of the fastener which is present on the hydraulic hose to be attached or removed. The opening in the adaptor may be shaped to receive six point or twelve point fasteners, or the opening may otherwise be shaped accordingly to the required application.

Figure 4:
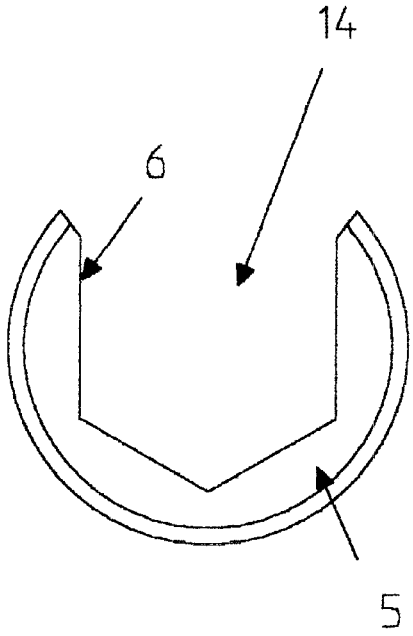
FIG. 4 is an elevation showing the end of the tool having an adaptor fitted thereto.
Figure 5:
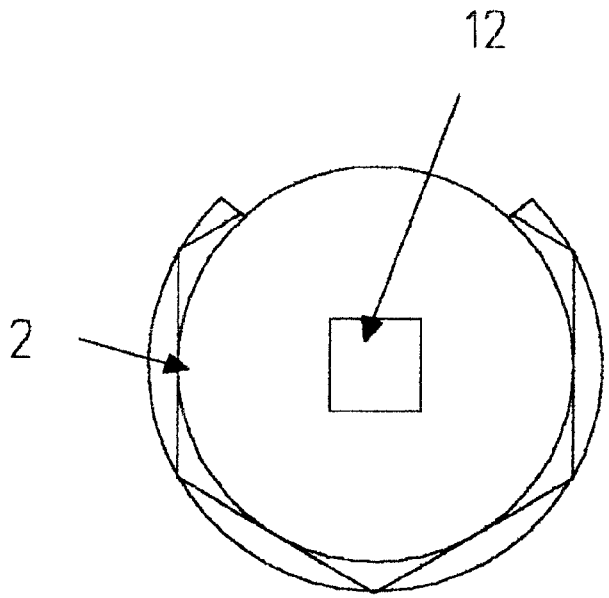
FIG. 5 is an elevation showing the end of the tool which is opposite FIG. 4, showing the drive hole.
Figure 6:
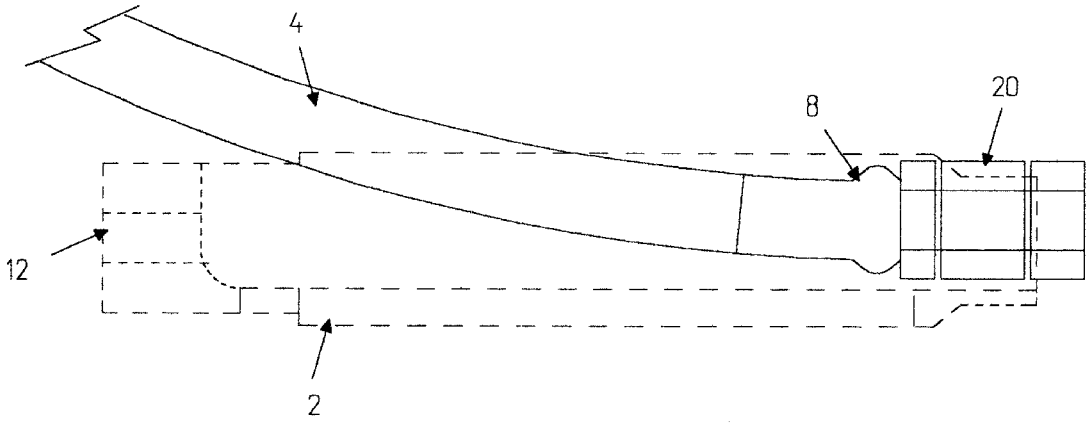
FIG. 6 is a side elevation of the device shown as a phantom, with the hose having a fitting thereon positioned within the tool, for use with the tool.

In the preferred embodiment, the hex shaped opening in the adaptor is actually four sided, with the remaining two sides of the hexagonal shape eliminated. FIG. 4. This shape allows the device to accept the fastener of the fitting which is attached to the hose, and firmly grasp the fastener for rotation of the fastener. On the end of the body opposite the hex shaped end, a drive hole 12 is provided. FIG. 5. This drive hole is sized appropriately for the drive tool, and will most commonly be rectangular according to the drives of ratchets, torque wrenches and impact wrenches in common use. By way of example, the drive hole could be one-quarter inch, three-eighths inch, or one-half inch, or larger, as is appropriate to the fitting, the job and the drive tool to be used. The longitudinal opening 14 of the body is preferred to not extend to the end in which the drive hole is located, so that increased structural integrity is provided in close proximity of the drive hole. Since the application of torque to the device occurs at the drive hole, the structural integrity of the device at this position is important.

In the preferred embodiment, the device also provides an external hexagonal shaped drive 16. As shown, this hex shaped drive has four sides and is open as part of the opening to the longitudinal body. This external hexagonal drive receives an open-end wrench and allows an open-end wrench to be used to rotate the device. An open-end wrench of the appropriate size is attached to the device and is rotated to rotate the device.

A portion of the external surface 18 may be knurled to accommodate handling and manual rotation of the device. A pegboard hole 10 may be provided.

As is demonstrated by FIG. 4, the slotted opening of the hollow, longitudinal body, gives the device a u-shape when viewed from the end. In use, the hex opening is mated with the six-point fastener 20 of the fitting. The remainder of the fitting, and the end of the hose to which the fitting is attached, extend into the hollow body, and out of the slotted opening. Accordingly, the slotted opening facilitates the engagement of the hex end and accommodates the hose.

When attaching a fitting, the device may be initially rotated by hand for the purpose of engagement of the fitting.

Additional torque may be supplied by means of a drive tool fitted to the drive hole. Alternatively, or additionally if increased torque is desired, the hand wrench may be fitted to the external hex. The device is now used to apply torque to the fastener to attach the hose. The hose and fitting are removed in a similar manner by rotating the device in the opposite direction. A drive tool may be fitted to the device by means of the drive hole, and if additional torque is required to loosen the fitting, a hand wrench may be applied to the exterior hexagonal shaped portion of the body.

Figure 1:
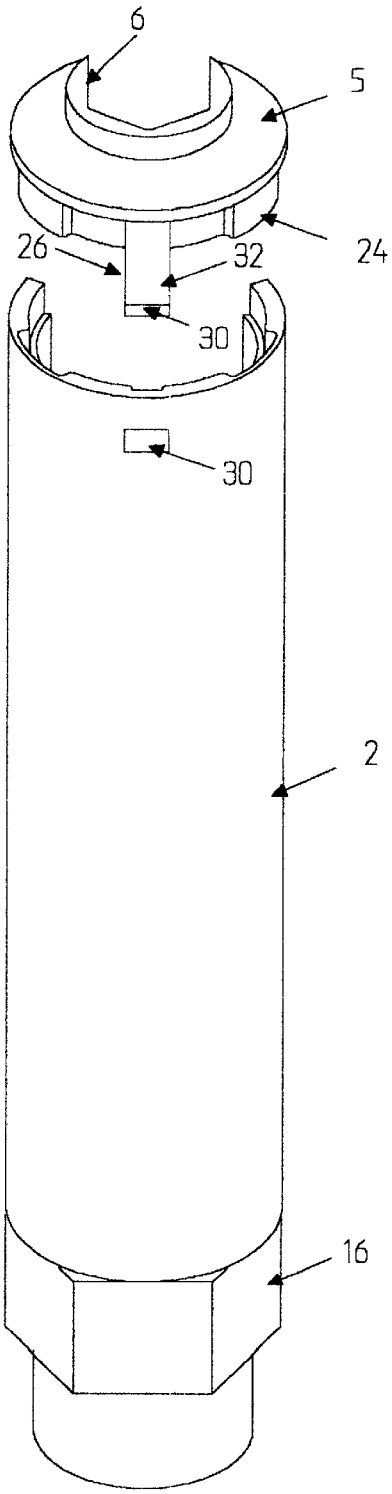
FIG. 1 is an exploded view of the device.

Adaptors having openings of various sizes may be provided. The openings are matched to the fitting or fastener to be attached or removed, and the adaptor selected accordingly. Adaptors having openings of various sizes may be fitted to a single body, since the adaptors are uniform as structured to be received by and engage the body. As shown in FIG. 1, the end of the body of the device, which receives and engages the adaptor, has multiple alternating peaks and valleys 22 such as in a dentil or dentated fashion. The adaptor has multiple alternating peaks and valleys 24 in the same manner, but opposite to the peaks and valleys of the body, so that the adaptor engages the end of body as shown in FIG. 1. The peaks and valleys may be described as symmetrical tabs which engage in a male female relationship with a corresponding tab on the other part. The tabs hold the adaptor in place on the body, and receive a torque transfer from the body to the adaptor, which is in turn transferred to the fitting to be attached or removed.

As shown in FIG. 1, the adaptor has a connector, 26. The connector extends from the adaptor into an interior of the body. The connector engages a corresponding receptacle 28, which is located in the body of the device. The connector holds the adaptor in place on the body. The connector engages the receptacle in a male-female relationship. Multiple connectors could extend from the adaptor to corresponding receptacles located in the body.

In the preferred embodiment, the connector extends from the adaptor past the dentated portion thereof. The connector may be described as a spring bar which may be displaced by the application of manual pressure, but which will return to its original position when pressure is removed. A tang 30 is located at or near an end of the connector. The tang extends at an angle, which may be a right angle, from the shank 32 of the connector. The tang engages the receptacle on an interior of the body. The receptacle may be a void which extends partially or completely through the wall of the body. If the receptacle extends through the wall of the body, access is available from the exterior to force the tang from the receptacle to remove the adaptor connection to the body. The tang may extend though the wall to the exterior of the body in this configuration. The adaptor may be released by thumb pressure or other pressure applied to the portion of the tang which extends through the wall of the body.

What is claimed is:

1. A tool for attaching and removing a fitting which is attached to a hose, comprising:

a generally hollow, extended and longitudinal body having an opening therein along a length thereof from a first end of said body to a point along a length of said body, but is not open along said length of said body to a second end thereof;

an adaptor which is removably mounted to said first end of said body, wherein said adaptor has an opening which extends from a first end of said adaptor to a second end of said adaptor, wherein said opening of said adaptor intersects the opening of said generally hollow extended and longitudinal body, and wherein said adaptor has a connector which extends from said adaptor toward said body, and said connector engages a receptacle of said body;

wherein said generally hollow, extended and longitudinal body is mounted to said adaptor by male-female engagement means; and wherein said connector extend s past said male-female engagement means and into an interior of said body.

2. A tool for attaching and removing a fitting that is attached to a hose, comprising;

a generally hollow, extended and longitudinal body having a longitudinal slot along one side thereof for accepting a hose, said generally hollow, extended and longitudinal body having a first end and a second end, said second end of said generally hollow, extended and longitudinal body having an aperture for accepting a drive tool;

an adaptor which is removably mounted to a first end of said generally hollow, extended and longitudinal body, said adaptor having an opening for accepting and engaging a fastener and wherein said adaptor has a connector which extends from said adaptor toward said body, and said connector engages a receptacle of said body;

wherein said longitudinal slot extends through said first end and intersects said opening in said adaptor;

wherein said generally hollow, extended and longitudinal body is mounted to said adaptor by male-female engagement means; and wherein said connector extends past said male-female engagement means and into an interior of said body.

3. A tool for attaching and removing a fitting which is attached to a hose, comprising:

a generally hollow extended and longitudinal body having an opening therein along a length thereof from a first end of said body to a point along a length of said body, but is not open along said length of said body to a second end thereof;

an adaptor which is removably mounted to said first end of said body, wherein said adaptor has an opening which extends from a first end of said adaptor to a second end of said adaptor, wherein said opening of said adaptor intersects the opening of said generally hollow extended and longitudinal body, and wherein said adaptor has a connector which extends from said adaptor toward said body, and said connector engages a receptacle of said body; and wherein said connector comprises a shank which is attached to said adaptor at one end, and which has a tang near an opposite end, wherein said tang engages said receptacle of said body.

4. A tool for attaching and removing a fitting that is attached to a hose, comprising:

a generally hollow, extended and longitudinal body having a longitudinal slot along one side thereof for accepting a hose, said generally hollow, extended and longitudinal body having a first end and a second end, said second end of said generally hollow, extended and longitudinal body having an aperture for accepting a drive tool;

an adaptor which is removably mounted to a first end of said generally hollow, extended and longitudinal body, said adaptor having an opening for accepting and engaging a fastener and wherein said adaptor has a connector which extends from said adaptor toward said body, and said connector engages a receptacle of said body;

wherein said longitudinal slot extends through said first end and intersects said opening in said adaptor; and wherein said connector comprises a shank which is attached to said adaptor at one end, and which has a tang near an opposite end, wherein said tang engages said receptacle of said body.

5. A tool for attaching and removing a fitting attached to a hose, as described in claim 3, wherein said receptacle extends through an exterior wall of said body, and wherein said tang engages said receptacle and extends though said receptacle and beyond said exterior wall of said body.

6. A tool for attaching and removing a fitting attached to a hose, as described in claim 4, wherein said receptacle extends through an exterior wall of said body, and wherein said tang engages said receptacle and extends though said receptacle and beyond said exterior wall of said body.

* * * * *